US005390998A

United States Patent [19]

Friedman

[11] Patent Number: 5,390,998

[45] Date of Patent: Feb. 21, 1995

[54] DISPLAY CASE FOR JEWELRY

[75] Inventor: Kenneth Friedman, New York, N.Y.

[73] Assignee: Charles Wolf & Sons, Inc., New York, N.Y.

[21] Appl. No.: 53,999

[22] Filed: Apr. 26, 1993

[51] Int. Cl.[6] ..... A47F 3/00; A47F 9/00

[52] U.S. Cl. ..... 312/117; 312/140.4

[58] Field of Search ..... 312/137, 138.1, 140, 312/140.1-140.4, 114, 117, 126; 211/135, 186, 10-11, 49.1, 184; 108/618, 60

[56] References Cited

U.S. PATENT DOCUMENTS

| | | | |
|---|---|---|---|
| 809,441 | 1/1906 | Hanks | 312/140.4 X |
| 953,911 | 4/1910 | Kress | 312/137 |
| 1,109,339 | 9/1914 | Klein | 312/137 |
| 1,295,647 | 2/1919 | Walker | 312/137 |
| 1,642,466 | 9/1927 | Sorensen . | |
| 1,787,809 | 1/1931 | Allen et al. . | |
| 2,125,523 | 8/1938 | Smith | 312/114 |
| 2,217,725 | 10/1940 | Bloomfield | 312/114 |
| 2,305,279 | 12/1942 | Smith . | |
| 2,942,924 | 6/1960 | Stangert | 312/140.4 |
| 3,582,170 | 6/1971 | Schaeffer et al. | 312/140.4 |
| 3,632,180 | 1/1972 | Hauville | 312/140.4 X |
| 3,872,976 | 3/1975 | Moore et al. | 312/140.4 X |
| 4,503,780 | 3/1985 | Apissomian | 312/140 X |
| 4,503,982 | 3/1985 | Lewis | 312/140.4 X |

*Primary Examiner*—Stephen C. Pellegrino
*Assistant Examiner*—Nancy Mulcare
*Attorney, Agent, or Firm*—Natter & Natter

[57] ABSTRACT

A jewelry display case adapted for mounting in an elevated position relative to a substantially horizontal countertop of a floor cabinet includes a pedestal for transferring the weight of the display case to the countertop. The pedestal is provided with a depending plate member clampingly engageable between two contiguous floor cabinets to provide lateral stability to the display case. In an alternate embodiment, stability is provided by a set of clip members engageable with an edge molding of the countertop. The display case further includes a shelf that is positionably adjustable along the height of a display wall and angularly adjustable for exhibiting the jewelry.

9 Claims, 2 Drawing Sheets

DISPLAY CASE FOR JEWELRY

BACKGROUND OF THE INVENTION

1. Field of the Invention

This invention relates generally to show-cases and especially to a display case for exhibiting jewelry.

In particular, the invention concerns a display case having a space-saving above-the-counter mounting arrangement.

2. Background Art

Retail establishments conventionally exhibit merchandise in glass-enclosed cabinets supported on a floor surface that usually include a horizontal countertop. Additionally, display racks, stands, shelves and cases are frequently placed on the countertop. A problem with these auxiliary display devices is that they obscure the customer's view of the merchandise below the countertop and also present a cluttered appearance. Typical auxiliary display cases are for example, shown in U.S. Pat. Nos. 1,787,809 and 2,125,523. A further disadvantage is that these countertop display cases are not designed to be attached to a countertop and can thus readily be removed thereby providing a security risk especially when expensive jewelry is being displayed.

Another display case, as shown in U.S. Pat. No. 2,217,725, is supported above a countertop by brace members attached to a floor cabinet. A portion of the brace member projects below the cabinet countertop and is attached to the rear surface of the cabinet. This installation inherently limits the placement of the display case to cabinets having brace supporting structure and furthermore, the braces interfere with behind-the-counter access to the merchandise within the floor cabinet. Additionally, the brace attachment is of a permanent nature and does not provide for the display case to be readily re-positioned at different locations on the countertop.

BRIEF DESCRIPTION OF THE INVENTION

Briefly, the nature of this invention involves a display case and countertop mounting arrangement providing elevated support.

The mounting arrangement includes a pedestal having a depending stabilizer member. The pedestal is adapted to rest on the countertop with the stabilizer member clampingly secured between confronting edge surfaces of adjacent countertops. Additionally, a cushion pad is positioned at the interface of the pedestal and an upper surface of the countertop.

In another embodiment, a set of clip members depend from the pedestal. The clip members are adapted for cooperatively engaging an edge molding strip of the countertop.

The display case has a generally triangular cross-sectional configuration and is constructed with transparent wall members. The interior space of the display case is adapted for selectively exhibiting jewelry positioned generally at consumer eye-level.

A feature of this invention is that the display case can be mounted above a cabinet countertop and secured to the cabinet at selected locations without requiring permanent attachment to the countertop.

Another aspect of this invention is that the display case can be mounted without limiting access to the merchandise within the cabinet or blocking the view of merchandise exhibited below the countertop.

In view of the foregoing, it should be apparent that the present invention overcomes many of the deficiencies of the prior art and provides an improved display case for jewelry and the like.

Having thus summarized the invention, it will be seen that it is an object thereof to provide a jewelry display case of the general character described herein which is not subject to the aforementioned disadvantages.

Another object of this invention is to provide a display case having a pedestal for raised mounting with respect to a countertop.

A further object of this invention is to provide a display case wherein the pedestal is firmly securable to the countertop for deterring unauthorized removal thereof, yet can be readily released.

Yet another object of this invention is to provide a display case for presenting merchandise to a consumer at eye-level.

Still another object of this invention is to provide a display case that is readily adaptable for use in combination with existing floor cabinet countertops.

An additional object of this invention is to provide a display case having a mounting arrangement that is relatively simple in construction, reliable in use and economical to manufacture.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown exemplary embodiments of the invention.

DETAILED DESCRIPTION OF THE INVENTION

Figure 1:
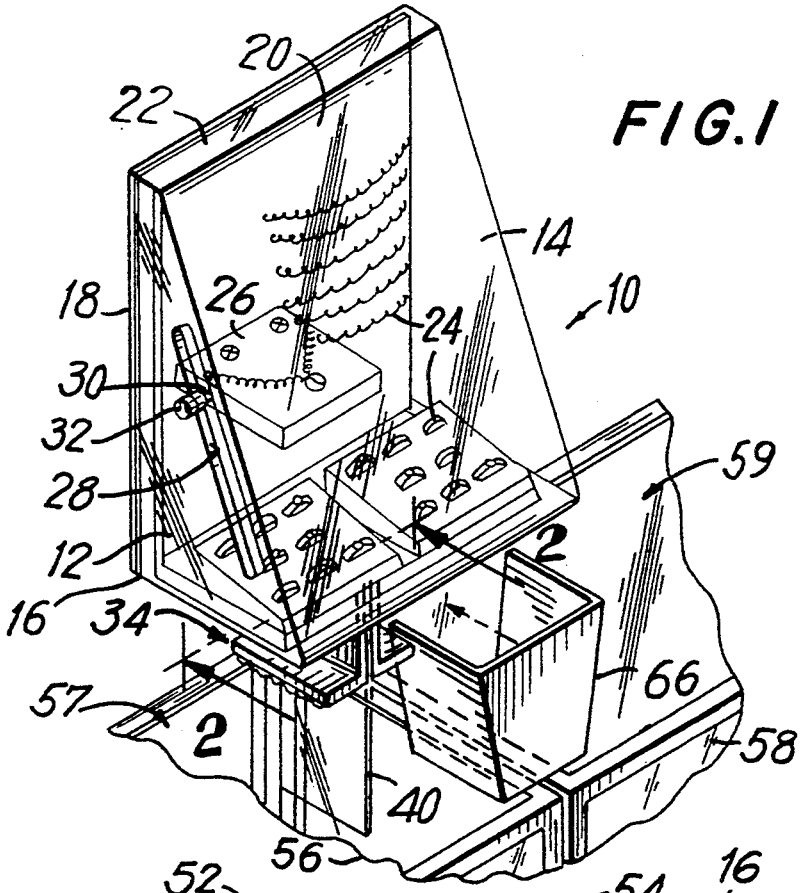
FIG. 1 is a perspective view of the display case of this invention showing a pedestal for mounting the case at the juncture of two contiguous floor cabinets.

With specific reference now to the figures in detail, it is stressed that the particulars shown are by way of example and for the purposes of illustrative discussion of the preferred embodiments of the present invention only and are presented in the cause of providing what is believed to be the most useful and readily understood description of the principles and conceptual aspects of the invention. In this regard, no attempt is made to show structural aspects of the invention in more detail than is necessary for a fundamental understanding of the invention, the description taken with the drawings making apparent to those skilled in the art how the several forms of the invention may be embodied in practice.

Referring now in detail to the drawings, the reference numeral 10 denotes generally a merchandise display case particularly suited for exhibiting jewelry, as encompassed by this invention.

The display case 10 is defined by an enclosure formed with a pair of triangular shaped side walls 12, 14, a base 16, a back wall 18, an inclined front wall 20 and a top wall 22. The back wall 18 is hingedly connected to the base 16 and is further lockably securable at its uppermost edge to the front wall 20. The walls 12–22 are preferably fabricated from rigid sheets of a transparent plastic material such as Lexan. Further, by way of example, the typical dimensions of the display case 10 include a width dimension of 30 cm., a heighth of 35 cm., a depth at the base 16 of 18 cm., and a depth dimension of the top wall 22 of 4 cm.

The interior of the display case 10 is designed to accommodate selected arrangements of ring boxes, earring display cards and necklace racks, collectively referred to by reference numeral 24. Additionally, a shelf 26 is adjustably attachable to the side wall 12. For this purpose, a slot 28 substantially parallel to the angle of inclination of the front wall 22, is provided in the wall 12. The shelf 26 is substantially planar and includes a laterally projecting threaded stud 30 extendable through the slot 28. A knurled nut 32, preferably fabricated of a transparent plastic, is provided with an internally threaded bore for accommodating the stud 30. The shelf 26 can be slidably moved along the slot 28 and by finger tightening the nut 32, the shelf 26 can be fixedly secured in a selected location. It should also be observed that the plane of the shelf 26 can also be rotated about the stud 30 and locked at a preferred angular orientation for effectively exhibiting the jewelry. It should also be noted that the back wall 18 is swingable outwardly about the hinged connection for accessing the interior of the display case 10. Furthermore, the interior surface of the back wall 18 can be provided with Velcro or a similar type fastener for releasably attaching the display card 24 as shown in FIG. 1.

Figure 2:
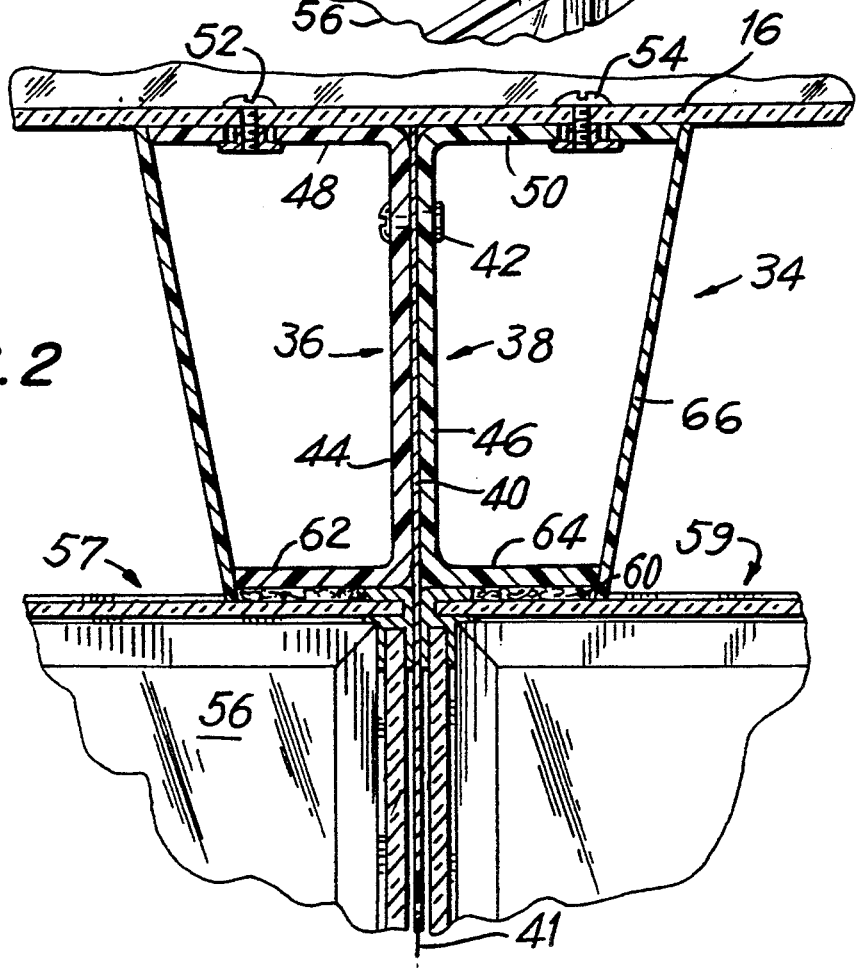
FIG. 2 is an enlarged sectional view taken substantially along line 2—2 of FIG. 1 showing in detail the pedestal structure including a stabilizer member.

With regard to the mounting of the display case 10, reference is made to FIG. 2 wherein a pedestal 34 is illustrated in sectional view. The pedestal 34 includes two channel members 36, 38 and a stabilizer member 40. The stabilizer member 40 is comprised of a plate member having a thickness dimension of approximately 3 cm, a length dimension of about 30 cm, and a width dimension of between 10–30 cm. The channel members 36, 38 are fastened along a respective web portion 44, 46, typically by a screw member 42, with the stabilizer member 40 sandwiched therebetween and lying coincidentally to a longitudinal axis 41 of the pedestal 34. An upper flange 48, 50 of the respective channel members 36, 38 is secured by a screw member 52, 54 to the base 16 of the display case 10. The length of the pedestal 34 is approximately 12–14 cm. By way of example, the channel members 36, 38 are formed from rigid plastic and the stabilizer 40 is similarly fabricated in the form of a panel or can be made of sheet metal.

The pedestal 34 is adapted to be supported between a pair of floor display cabinets 56, 58 which are placed in abutting contact with the stabilizer member 40 being clampingly engaged at the juncture between the cabinets 56, 58. Additionally, an adhesive-backed cushion pad 60 is placed between a lower flange 62, 64 and a countertop 57, 59 of the respective cabinets 56, 58.

It has been found that the pedestal 34 effectively transfers the load of the display case 10 to the floor display cabinets 56, 58 and that the stabilizer member 40 provides lateral stability. It should also be apparent that the display case 10 can be readily removed by separating the cabinets 56, 58.

The length dimension of the lower flanges 62, 64 is less than of the upper flanges 48, 50 to provide a tapered profile as shown in FIG. 2. A cover member 66 conforming to the tapered angulation of the channel members 36, 38 is slidably positionable around the channel members 36, 38 as indicated by the arrow in FIG. 1, to present a finished appearance.

Figure 4:
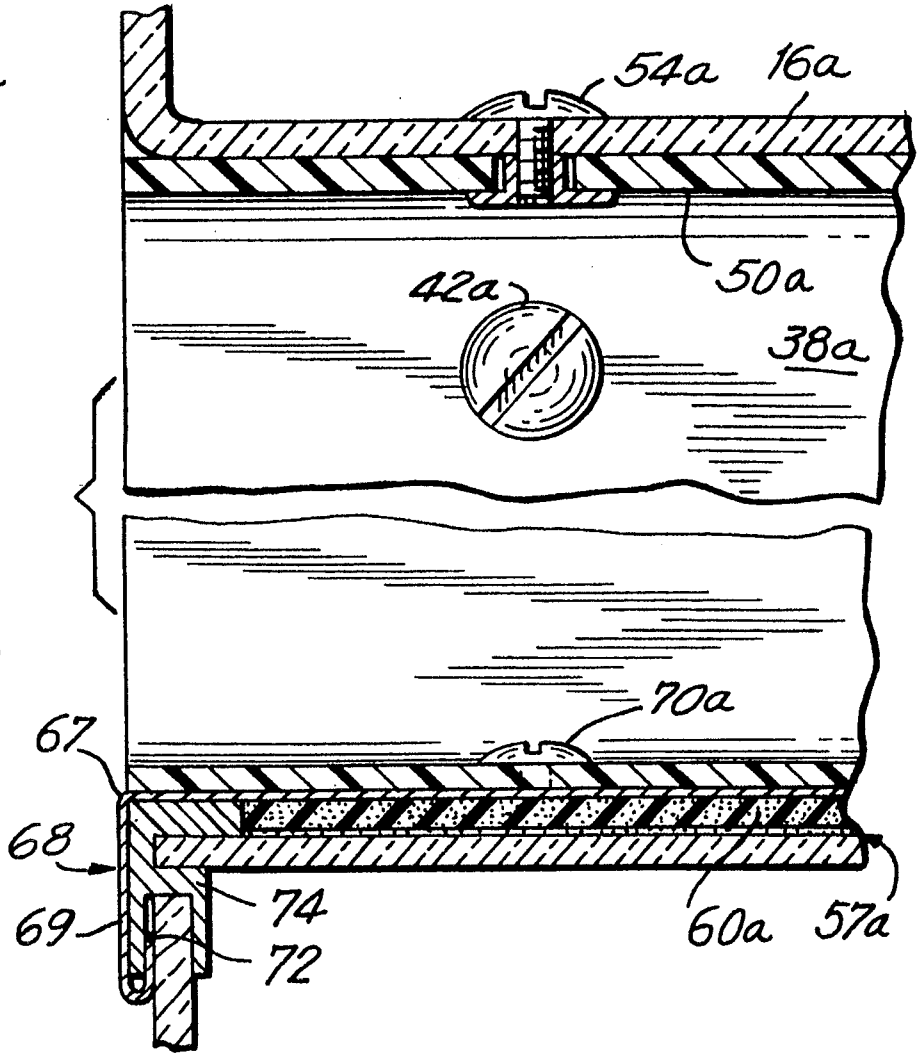
FIG. 4 is an enlarged sectional view taken substantially along line 4—4 of FIG. 3 and illustrating engagement of the clip members with the molding strip.
Figure 3:
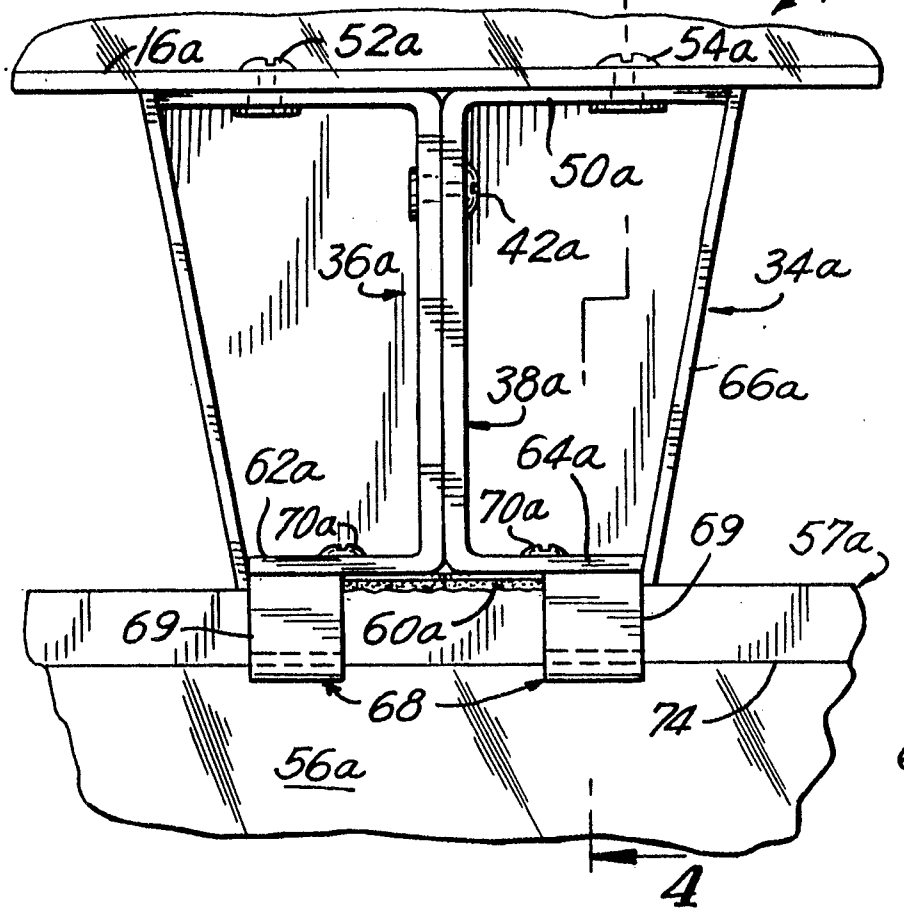
FIG. 3 is a back elevational view of an alternate embodiment of a pedestal showing a set of clip members for engaging a countertop molding strip.

In an alternate embodiment shown in FIGS. 3 and 4, the same reference numerals have been used to represent corresponding elements with the addition of the letter "a". The mounting support for a display case **10*a* is provided by a pedestal 34*a* comprising companion channel members 36*a*, 38*a* as in the previous embodiment. The stabilizer 40 has been replaced in this version, by a set of clip members 68. The clip members 68 are preferably formed with a base section 67 conforming to the dimensions of a set of lower flange members 62*a*, 64*a* and is typically attached to the flanges 62*a*, 64*a* by a fastener such as screws 70*a*. The clip members 68 are further angulated normally with respect to a substantially horizontal plane of the flange members 62*a*, 64*a* to form a tab 69. The clip members 68 also include an upturned lip 72 adapted to lockingly engage a countertop edge molding strip 74 of a floor display cabinet 56*a*. Additionally, an adhesive-backed cushion pad 60*a* is provided between the lower flanges 62*a*, 64*a* and a countertop 57*a* of the floor display cabinet 56*a*. The cushion pad 60*a* is adapted to have a thickness dimension corresponding to the depth dimension of the edge molding strip 74 extending above the countertop 57*a* to provide for flush mounting on the countertop 57*a*. A cover member 66*a* is positionable so as to surround the pedestal 34*a*. It should be apparent that the display case 10*a* can be readily removed by releasing the clip 68**.

It should thus be seen that there is provided a display case for jewelry and the like which achieves the various objects of this invention and which is well adapted to meet conditions of practical use.

Since various possible embodiments might be made of the present invention or modifications might be made to the exemplary embodiment set forth above, it is to be understood that all materials shown and described in the accompanying drawings are to be interpreted as illustrative and not in a limiting sense.

Having thus described the invention, there is claimed as new and desired to be secured by Letters Patent:

1. A jewelry display case for elevated mounting to a floor display cabinet, having a substantially horizontal countertop, said display case comprising an enclosure for exhibiting merchandise, said enclosure being defined by a base member and at least one wall extending upwardly from the base member, pedestal means for supporting the enclosure spaced above the countertop, said pedestal means defining an upper flange and a lower flange, said upper flange being secured to the base member, said lower flange being adapted for placement on the countertop, said pedestal means further including stabilizer means extending from the lower flange, said stabilizer means being substantially coincidental to a longitudinal axis of the pedestal means extending perpendicular to a horizontal plane defined by the lower flange, said stabilizer means further being positionable below the countertop for clampable engagement at a juncture between two contiguous display cabinets to releasably secure the display case.

2. A jewelry display case as claimed in claim 1 wherein at least one wall of said enclosure defines a slotted opening, a movable shelf within the enclosure, said shelf including a stud projecting through the slotted opening and fastening means adapted for engagement with the stud for securing the shelf at selected height and angular orientations along the slotted opening.

3. A jewelry display case as claimed in claim 2 wherein the pedestal means is comprised of plural channel members, each of said channel members each having an upper flange and a lower flange connected by an intermediate web section, at least two of said channel members being connected along said respective web sections.

4. A jewelry display case as claimed in claim 1 further including a cover member, said cover member being adapted for selective placement in surrounding relationship with respect to the pedestal means.

5. A jewelry display case for elevated mounting to a floor display cabinet, having a substantially horizontal countertop, including an edge molding strip, said display case comprising an enclosure for exhibiting merchandise, said enclosure being defined by a base member and at least one wall extending upwardly from the base member, pedestal means for supporting the enclosure spaced above the countertop, said pedestal means defining an upper flange and a lower flange, said upper flange being secured to the base member, said lower flange being adapted for placement on the countertop, said pedestal means further including stabilizer means extending below said lower flange, said stabilizer means including at least one clip member, said clip member defining a base section secured to the lower flange and being substantially coextensive therewith, said clip member further defining a tab extending substantially perpendicular with respect to a horizontal plane defined by the lower flange, an end of said tab defining an upturned lip, said lip being adapted to lockingly engage the countertop edge molding strip for releasably securing the display case.

6. A Jewelry case as claimed in claim 5 wherein at least one wall of said enclosure defines a slotted opening, a moveable shelf within the enclosure, said shelf including a stud projecting through the slotted opening and fastening means adapted for engagement with the stud for securing the shelf at selected height and angular orientations along the slotted opening.

7. A jewelry display case as claimed in claim 5 further including a cover member, said cover member being adapted for selective placement in surrounding relationship with respect to the pedestal means.

8. A jewelry display case as claimed in claim 5 wherein the pedestal means is comprised of plural channel members, each of said channel members each having an upper flange and a lower flange connected by an intermediate web section, at least two of said channel members being connected along said respective web sections.

9. A jewelry display case as claimed in claim 5 further including a cushion pad, said cushion pad having a thickness dimension corresponding to the depth dimension of the edge molding strip at the countertop, said cushion pad being interposed between the lower flange and the countertop for providing flush mounting of the pedestal means on the countertop.

* * * * *